United States Patent [19]

Motzer

[11] Patent Number: 4,903,728

[45] Date of Patent: Feb. 27, 1990

[54] SAFETY VALVE

[75] Inventor: Helmut Motzer, Leinfelden-Echterdingen, Fed. Rep. of Germany

[73] Assignee: HERION-Werke KG, Fellbach, Fed. Rep. of Germany

[21] Appl. No.: 344,351

[22] Filed: Apr. 26, 1989

[30] Foreign Application Priority Data

May 19, 1988 [DE] Fed. Rep. of Germany ..... 3817122

[51] Int. Cl.[4] ..... F15B 13/043

[52] U.S. Cl. ..... 137/596.16; 91/424; 137/596.18

[58] Field of Search ..... 91/424; 137/596.16, 137/596.18

[56] References Cited

U.S. PATENT DOCUMENTS 4,473,095 9/1984 Motzer ..... 137/596.16

*Primary Examiner*—Gerald A. Michalsky

*Attorney, Agent, or Firm*—Henry M. Feiereisen

[57] ABSTRACT

A hydraulic safety valve which is controlled by electromagnetically actuated pilot valves includes two valve bodies movable in opposite direction towards each other for regulating the connections between a pump port, two working ports and two tank ports. Upon occurrence of a faulty switching, both valve bodies are moved in a hydraulically locked end position so that the safety valve can be operated again only after eliminating the malfunction. By coupling the safety valve with a proportional pressure reducing valve, the pressure buildup and the speed of a consumer which is connected to the safety valve can be controlled.

9 Claims, 5 Drawing Sheets

SAFETY VALVE

BACKGROUND OF THE INVENTION

The invention refers to a safety valve, and in particular to a hydraulically actuatable five-way/two-way safety valve with a valve housing accommodating two valve bodies movable in opposite direction towards each other within a bore of the housing, two e.g. electromagnetically actuatable pilot valves, an inlet port for connection with a pump, two working ports and two tank ports, each valve body including a working piston which is actuated upon by the pressure fluid via control channels and the pilot valves, and further including control pistons connected to the working piston and regulating the passageways between the pump port, the working ports and the tank ports.

Safety valves of this kind are used e.g. for actuating the brake and the clutch of a mechanical press. For safety reasons, such a valve includes two directional control valves to ensure a braking upon failure of a valve.

SUMMARY OF THE INVENTION

The invention is based on the object to provide an improved safety valve of the above-mentioned type which allows an automatic checking of the valve without requiring any special additional checking elements.

A further object of the present invention is to provide an improved safety valve which allows a control of speed and pressure built up at the consumer e.g. a differential cylinder.

This object and others which will become apparent hereinafter are attained in accordance with the present invention by designing each of both valve bodies with three axially spaced control pistons which cooperate with respective control edges within the housing in normal position of the valve so as to allow a connection of the pump port P with the working port B and of the working port A with the tank port R and which further allow a connection in switching position of the valve of the pump port P with the working port A and of the working port B with the tank port S, and which finally upon occurrence of a faulty switching allow a connection of the pump port P with the working port B and of the working port A with the tank port R.

Preferably, the safety valve is coupled with a proportional three-way pressure reducing valve having one side continuously connected with the tank port S of the safety valve, and another side connectable with the tank port R or the pump port P of the safety valve in dependence on its switching position.

BRIEF DESCRIPTION OF THE DRAWING

The above and other objects, features and advantages of the present invention will now be described in more detail with reference to the accompanying drawing in which.

DETAILED DESCRIPTION OF A PREFERRED EMBODIMENT

Figure 1:
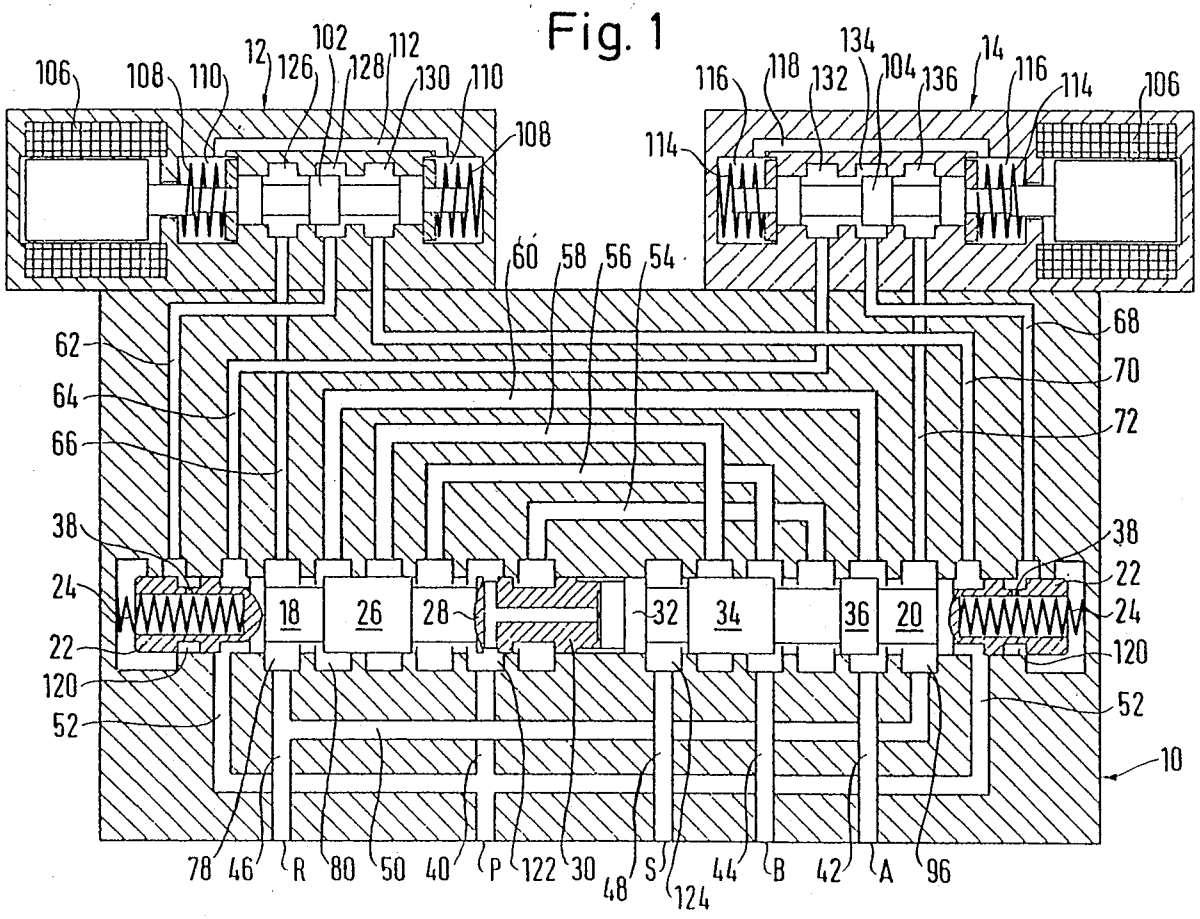
FIG. 1 is a schematic sectional view of one embodiment of a safety valve in accordance with the present invention in normal position.

Referring now to the drawing, and in particular to FIG. 1, there is shown a schematic sectional view of a safety valve in accordance with the invention, and in particular a five-way/two-way safety valve with a housing 10 and two electromagnetically actuatable pilot valves 12 and 14 flanged to the housing 10.

Provided in the housing 10 is a central bore 16 which accommodates two valve bodies 18, 20 axially moveable in opposite direction towards each other. Each valve body 18, 20 is provided with a working piston 22 which includes an undesignated blind-end bore accommodating a compression spring 24. By means of both compression springs 24 in each working piston 22, both valve bodies 18, 20 are urged in axial direction towards each other. In the normal position as shown in FIG. 1 in which the pilot valves 12, 14 are not excited, both valve bodies 18, 20 abut each other with their opposing end faces.

The valve body 18 is provided with control pistons 26, 28, 30 and the valve body 20 is provided with control pistons 32, 34, 36.

Moreover, each working piston 22 includes a transverse bore 38 which connects the respective blind-end bore of the working piston 22 with the space outside the working piston 22 and which communicates with an annular groove 120 at the periphery of each working piston 22.

The central bore 16 is provided with axially spaced annular channels 78, 80, 82, 84, 86, 88, 90, 92, 94, 96 extending in planes transversely to their axis and with one-sided pockets 74, 76, 98, 100. The annular channels 78, 80, 82, 84, 86, 88, 90, 92, 94, 96 and the pockets 74, 76, 98, 100 define with the housing a plurality of control edges cooperating with the above-mentioned control pistons 26, 28, 30; 32, 34, 36.

The safety valve has a fluid inlet port P for connection with a pump, working ports A and B as well as outlets ports R and S for connection to a tank.

The pump port P is connected to an annular channel 122 of the central bore 16 by a passageway 40, and the working port A is connected to the annular channel 94 by a passageway 42 while a passageway 44 connects the working port B with the annular channel 90, and a passageway 46 connects the tank port R with the annular channel 78 and a passageway 48 connects the tank port S with an annular channel 124 of the central bore 16.

A branch 50 branches off the passageway 46 and extends to the annular channel 96, and two branches 52 branch off the passageway 40, with one branch 52 leading to the pocket 76 via an annular groove of the left working piston 22, and with the other branch 52 leading to the pocket 98 via an annular groove of the right working piston 22.

Moreover, the annular channels 86 and 92 are connected by a passageway 54, the annular channels 84 and 90 are connected by a passageway 56, the annular channels 82 and 88 are connected by a passageway 58 and the annular channels 80, 94 are connected by a passageway 60.

The pilot valve 12 is provided with a piston 102 which axially reciprocates in a bore of the valve housing 10. At unexcited electromagnet 106, the piston 102 is retained in the normal position as shown in FIG. 1 by compression springs 108 which are arranged in spring chambers 110. The spring chambers 110 are permanently connected via a passageway 112. The central bore of the pilot valve 12 is provided with axially spaced annular channels 126, 128, 130.

The pilot valve 14 includes a piston 104 which reciprocates in an axial bore and, at unexcited electromagnet 106, is retained in the normal position as shown in FIG. 1 by compression springs 114 accommodated in the spring chambers 116. Both spring chambers 116 are permanently connected with each other via a passageway 118. The central bore of the pilot valve 14 is provided with axially spaced annular channels 132, 134 and 136.

The housing 10 of the safety valve is further provided with control channels 62, 64, 66 and control channels 68, 70, 72, with control channel 62 connecting the pocket 74 with the annular channel 128 of the pilot valve 12, the control channel 64 connecting the pocket 76 with the annular channel 132 of the pilot valve 14, the control channel 66 connecting the annular channel 78 with the annular channel 126 of the pilot valve 12. The control channel 68 extends between the pocket 100 and the annular channel 134 of the pilot valve 14, the control channel 70 extends between the pocket 98 and the annular channel 130 of the pilot valve 12 and the control channel 72 connects the annular channel 96 with the annular channel 136 of the pilot valve 14.

After having described the individual elements of the safety valve in accordance with the invention, its mode of operation will now be set forth in more detail.

FIG. 1 illustrates the normal position in which both electromagnets 106 of the pilot valves 12, 14 are not excited. The left working piston 22 is acted upon by the pump pressure from pump port P via the right branch 52, the control channel 70, the pilot valve 12 and the control channel 62. Likewise, the right working piston 22 is acted upon by the pump pressure via the left branch 52, the control channel 64, the pilot valve 14 and the control channel 68. Since, however, pump pressure prevails also in the central bore 16 via the passageway 40 and an undesignated longitudinal bore and transverse bore within the valve body 18, these pressures compensate each other and both valve bodies 18, 20 are urged towards each other by their springs 24 until their end faces abut each other and occupy the normal position as shown in FIG. 1. In this position of the safety valve, the pump port P is connected via the passageway 40, the annular channel 122, the annular channel 84, the passageway 56 and the annular channel 90 with the passageway 44 and thus with the working port B. On the other hand, the working port A is connected with the passageway 46 and thus with the tank port R via the passageway 42, the annular channel 94, the annular channel 96 and the branch 50 (and also via passageway 60, annular channels 80, 78 and passageway 46).

Figure 2:
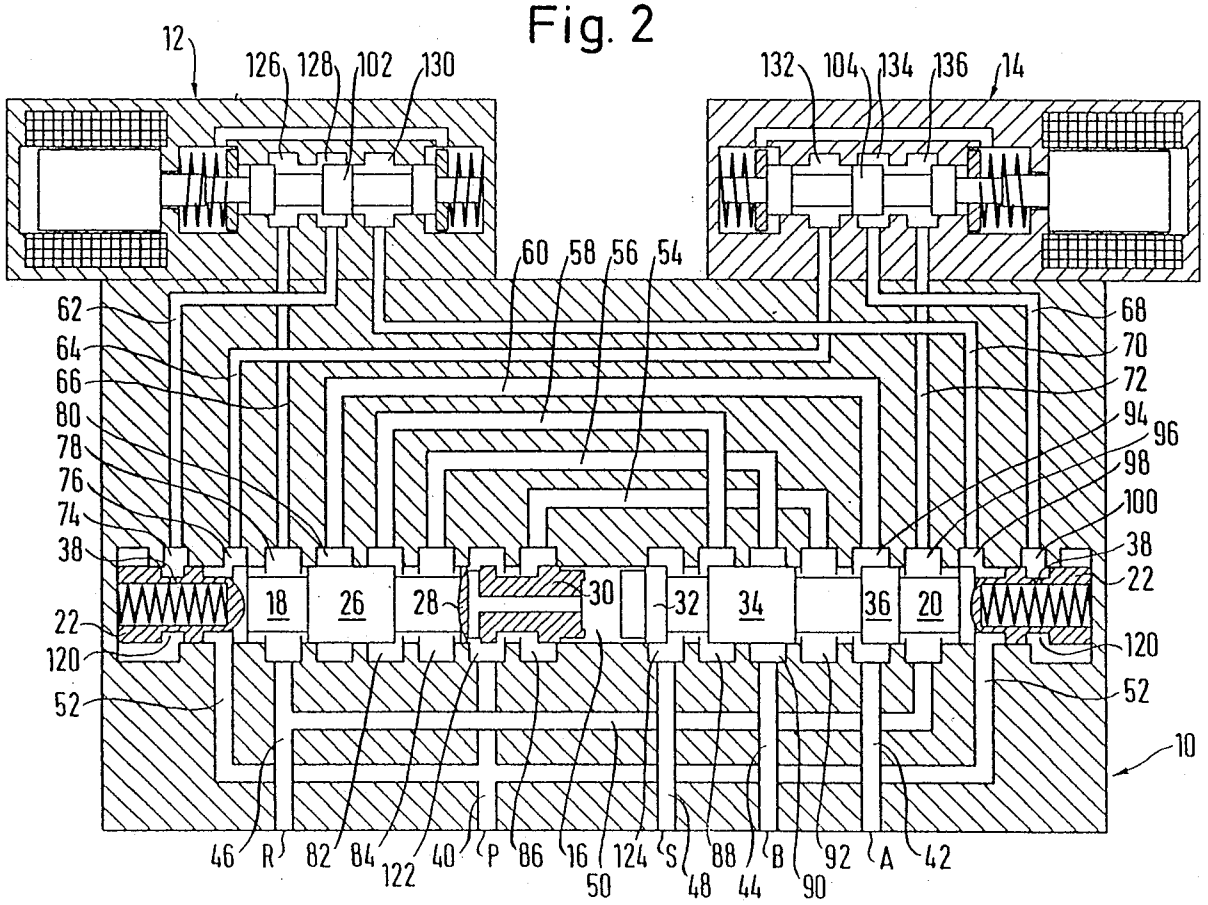
FIG. 2 is a sectional view of the safety valve in switching position.

In the switching position as shown in FIG. 2, the pilot valves 12 and 14 are activated so that their magnets are excited and their pistons 102, 104 are switched over into their switching position. The left working piston 22 is connected via its transverse bore 38, the annular groove 120, the pocket 74, the control channel 62, the pilot valve 12, the control channel 66 and the annular groove 78 to the passageway 46 and thus to the tank port R. The right working piston 22 is also connected to the tank port R via its transverse bore 38, the annular groove 120, the pocket 100, the control channel 68, the pilot valve 14, the control channel 72, the annular channel 96 and the branch 50. Since the full pump pressure also prevails in the central bore 16 as fluid flows from the pump port P via the passageway 40 and via undesignated bores within the valve body 18, both valve bodies 18, 20 are axially pushed apart until their working pistons 22 abut the housing as shown in FIG. 2.

In this switching position, the pump port P communicates with the passageway 42 and thus with the working port A via the passageway 40, the annular channels 122, 86, the passageway 54 and the annular channels 92, 94. The other working port B communicates with the other tank port S via the passageway 44, the annular channel 90, the passageway 56, the annular channel 84, the annular channel 82, the passageway 58 and the annular channels 88 and 124.

Figure 3:
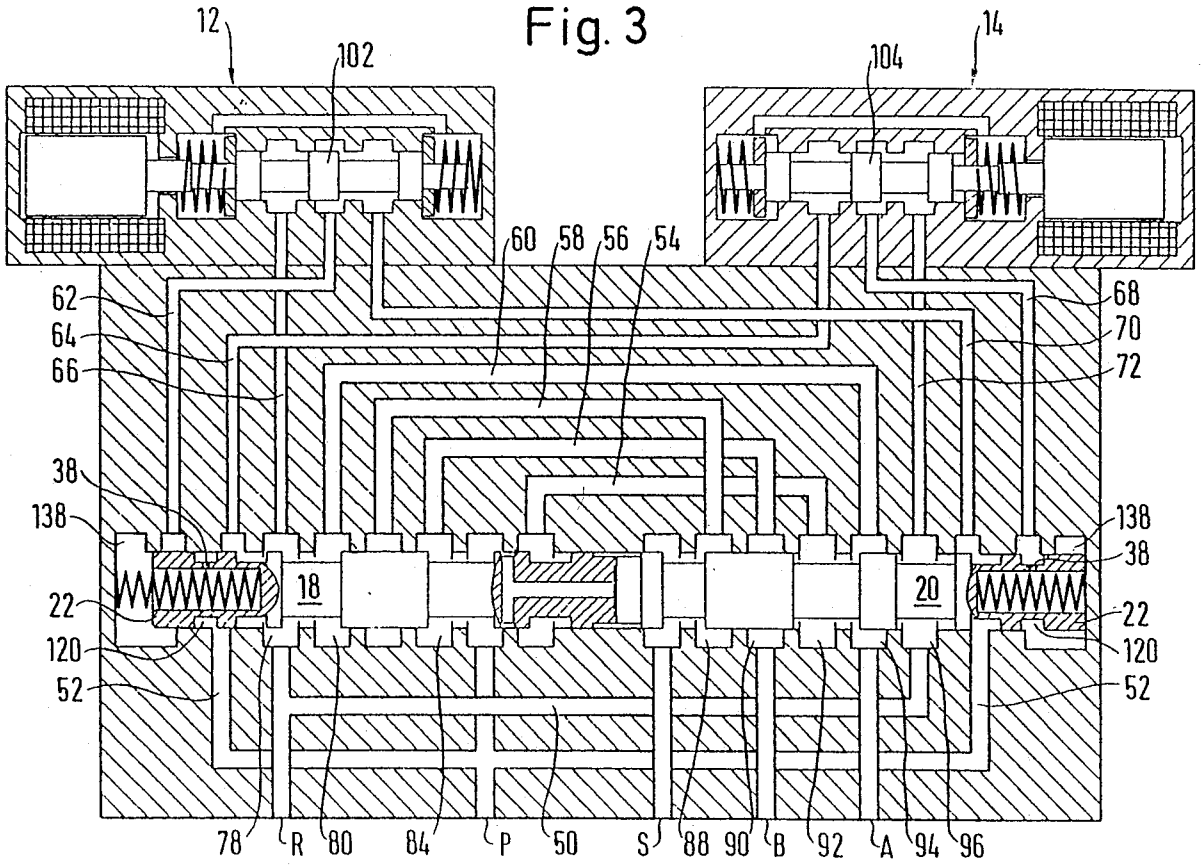
FIGS. 3 and 4 are schematic sectional views of the safety valve upon occurrence of a faulty switching.
Figure 4:
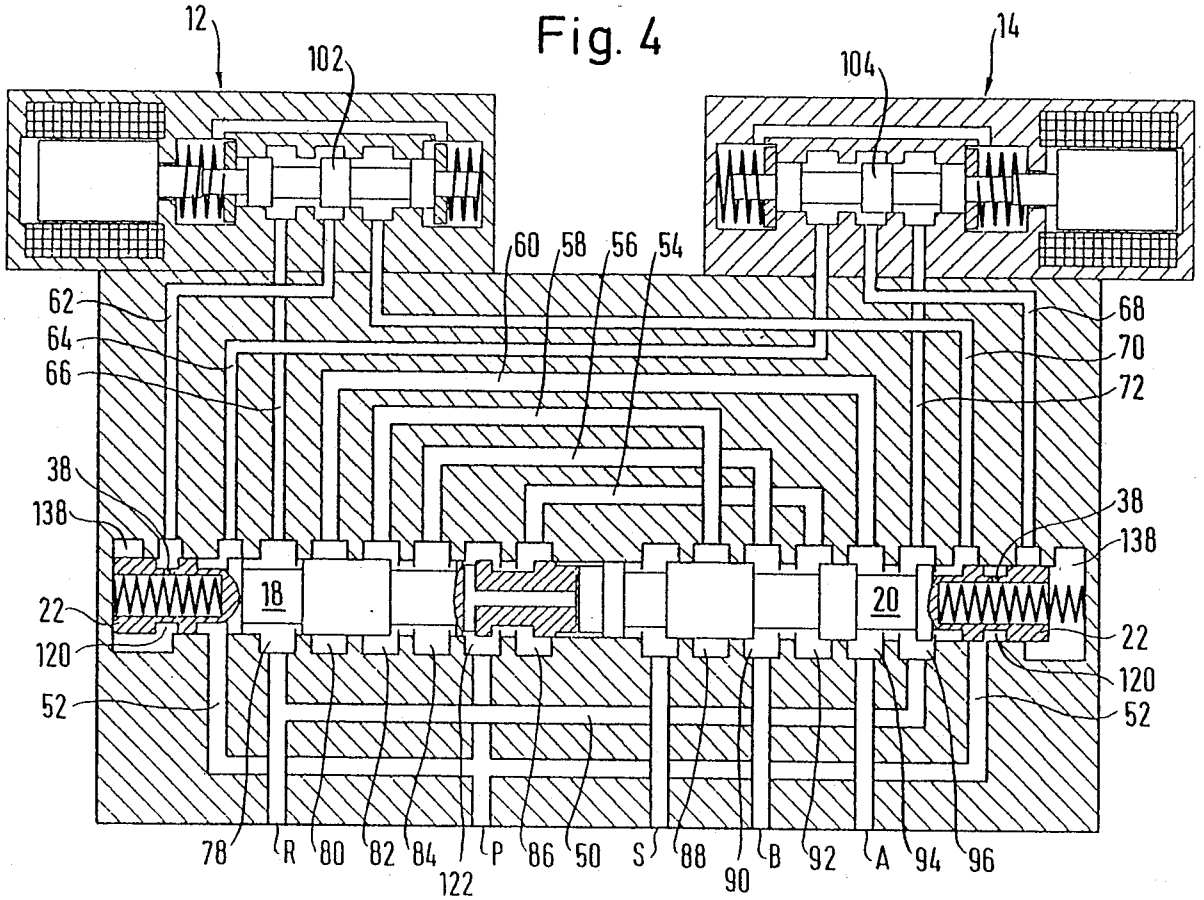

Turning now to FIGS. 3 and 4, there are shown two faulty switchings, with FIG. 3 referring to a situation in which the pilot valve 12 is not switched while the pilot valve 14 is switched, and with FIG. 4 illustrating the reversed situation in which the pilot valve 12 is switched while the pilot valve 14 is not switched.

At each faulty switching, the pump port P is connected with the working port B while the working port A communicates with the tank port R.

At the faulty switching as shown in FIG. 3, the pump port P is connected via the annular channel 84 and the passageway 56 to the annular channel 90 and thus to the working port B while the working port A communicates with the tank port R via the annular channel 94 and the passageway 60 as well as via the annular channels 80, 78.

At the faulty switching according to FIG. 4, the working port B communicates with the pump port P via the annular channels 90, 92, the passageway 54 and the annular channels 86, 122 while the working port A is in communication with the tank port R via the annular channels 94, 96 and the branch 50.

At the faulty switching according to FIG. 3, the full pump pressure prevails in the spring chamber 138 of the left working piston 22 since the spring chamber 138 is connected via the transverse bore 38 and the annular groove 120 to the branch 52 which communicates with the pump port P. On the other hand, the right working piston 22 is pressure-relieved because of its connection with the tank port R via the control channel 68, the pilot valve 14, the control channel 72 and the annular channel 96 as well as via the branch 50. In FIG. 4, these conditions are exactly reversed so that the spring chamber 138 of the right working piston 22 communicates via the branch 52 with the pump port P while the left working piston 22 is connected via the control channel 62, the pilot valve 12 and the control channel 60 as well as via the annular channel 78 to the tank port R and thus is pressure relieved.

These faulty switchings cannot be eliminated even when subsequent switching the defective element. For example, taking the situation as shown in FIG. 3, when the pilot valve 12 subsequently switches, the control channel 62 which is now at full pump pressure would be pressure-relieved via the control channel 66, the left working piston 22, however, still is acted upon by the full pump pressure via branch 52, annular groove 120 and transverse bore 38 as previously set forth. Furthermore, the right spring chamber 138 cannot be acted upon by the pressure fluid even when switching over the pilot valve 14 because pilot valve 14 communicates with the tank port R via the passageway 64, the pocket 76, the annular channel 78 and the passageway 46. The same is true for the faulty switching according to FIG. 4.

In order to make the valve operable after occurrence of a faulty switching, the malfunctions must initially be eliminated and the valve must be returned into the normal position through pressure relief at pump port P.

Figure 5:
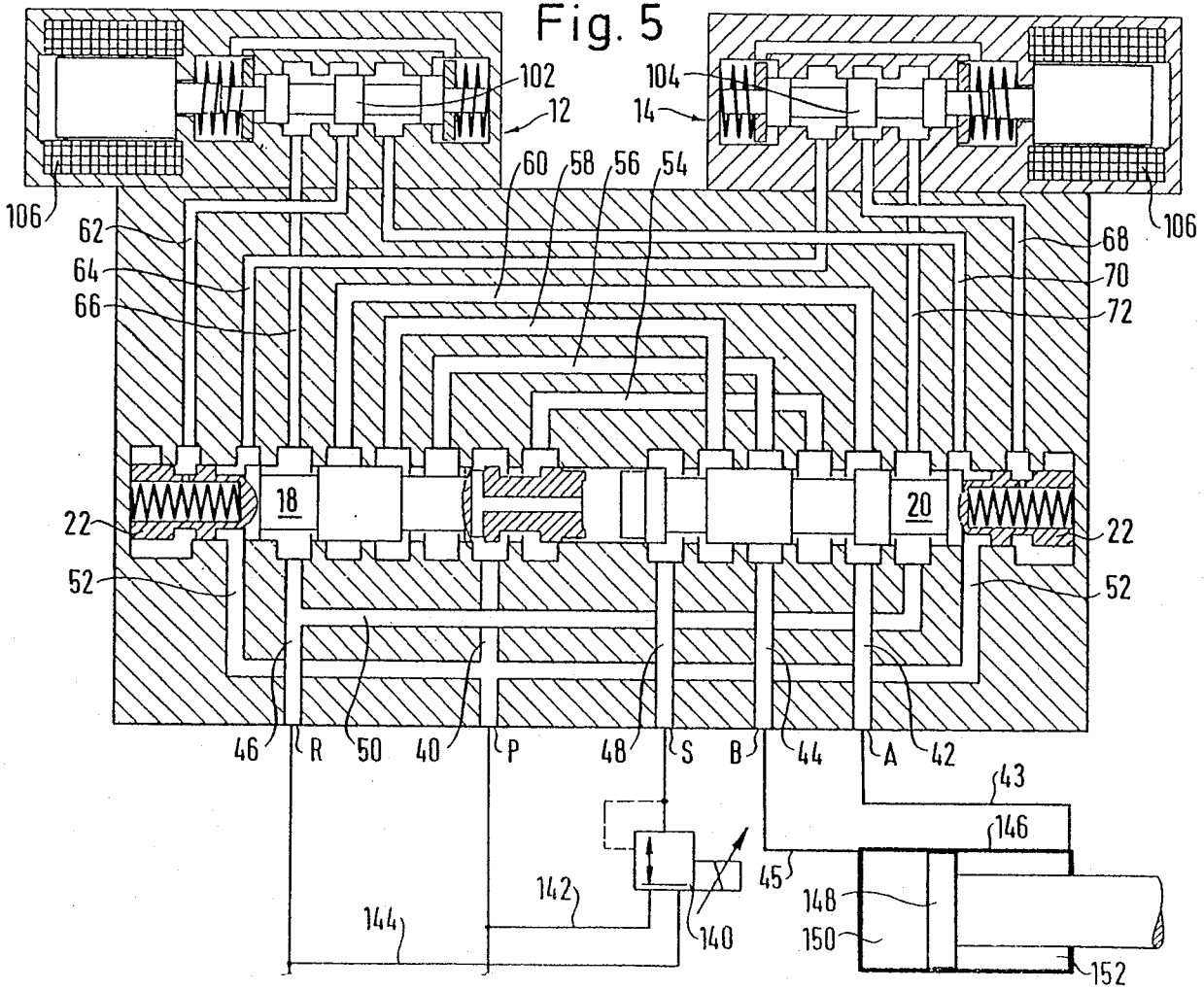
FIG. 5 is a schematic sectional view of the safety valve with a proportional pressure reducing valve.

Turning now to FIG. 5, there is shown the safety valve in accordance with the present invention in switching position and coupled with a proportional three-way pressure reducing valve which subsequently is referred to in short as pressure reducing valve.

As shown in FIG. 5, the pressure reducing valve 140 is continuously connected at one side by a line 49 while the other side thereof is a connectable depending on the switching position via a line 142 with the pump port P or via a line 144 with the tank port R.

The working ports A and B are connected via lines 43, 45 to a consumer e.g. a differential cylinder 146 provided with piston 148, with line 43 connecting the working port A with the space 142 at the side of the piston rod, and with line 45 connecting the working port B with the space 150 of the differential cylinder 146 at the side of the cylinder.

The safety valve according to FIG. 5, operates as follows.

The safety valve occupies the switching position in which, as previously set forth, the pump port P is connected with the working port A while the working port B is connected with the tank port S.

By suitably adjusting the pressure at the pressure reducing valve 140, the direction of motion of the piston 148 can be reversed and its speed can be controlled.

When setting, for example, the secondary pressure at the pressure reducing valve 140 to zero bar, pressure fluid such as oil flows from the space 150 at the cylinder side via the working port B to the tank port S and then via the pressure reducing valve 140 and the line 144 to the tank port R. On the other hand, the working port A and thus the space 152 of the differential cylinder 146 at the side of the piston rod is acted upon by the full pump pressure so that the piston 148 is displaced towards the left in FIG. 5. By suitably setting the secondary pressure at the pressure reducing valve 140, the discharge of the oil from space 150 can be controlled and thus the speed by which the piston 148 is advanced can be adjusted.

When setting the secondary pressure at the pressure reducing valve 140 to the pump pressure, oil flows from the pump port P via the line 142, the pressure reducing valve 140 and the tank port S to the working port B. Since the working port A is still connected to the pump port P, the pump pressure prevails in the cylinder-side space 150 as well as in the space 152 of the differential cylinder 146 at the side of the piston rod, however, since the piston end face at the side of the space 150 is greater than the piston end face at the side of the space 152 (because of the piston rod), the piston 148 is moved towards the right in FIG. 5. The oil thus displaced from space 152 flows via working port A to the pump port P.

In case the piston 148 is stopped e.g. at a work piece, the contact pressure can be adjusted by the pressure reducing valve 140, with the contact pressure being at a maximum towards the right when the full pump pressure prevails at the working port B while the contact pressure is at a maximum toward the left when the working port B is fully relieved through connection via the port S and the pressure relief valve 140 with the tank port R.

Upon occurrence of a faulty switching, the pressure relief valve 140 is inactive because the tank port S is blocked at each faulty switching.

Then, the piston 148 moves to the right until being stopped, since at each faulty switching, as previously set forth, the working port A is relieved through connection with tank port R while the working port B is connected to the pump port P.

Through the provision of a pressure reducing valve, it is possible to control the pressure buildup and pressure drop in the differential cylinder 146 and to adjust the speed of the piston 148 as well as to reverse its direction of motion.

While the invention has been illustrated and described as embodied in a safety valve, it is not intended to be limited to the details shown since various modifications and structural changes may be made without departing in any way from the spirit of the present invention.

What is claimed is new and desired to be protected by Letters Patent is set forth in the appended claims:

I claim:

1. A safety valve assembly, comprising:

valve housing defining a bore and having a fluid inlet port, two tank ports and two working ports, with said working ports being connected to a fluid operated system;

valve means including two valve bodies movable in opposite direction towards each other in said bore of said housing, each of said valve bodies including a working piston actuated by a pressure fluid and provided with axially spaced control pistons for regulating the flow of pressure fluid between said fluid inlet port, said working ports and said tank ports; and actuating means for displacing said valve bodies in said bore of said housing between a normal position and a switching position to allow said fluid inlet port to be alternately connected to one of said working ports while the other one of said working ports is pressure-relieved wherein upon occurrence of a faulty switching of said actuating means during switching between said normal position and said switching position, said control pistons maintain the previous connection between said fluid inlet port and said one working port while said other working port remains pressure-relieved.

2. A safety valve assembly as defined in claim 1 wherein each of said working pistons of said valve bodies includes three axially spaced control pistons.

3. A safety valve assembly as defined in claim 1 wherein in normal position of said valve means said control pistons connect said fluid inlet port with one of said working ports while said other working port is connected with one of said tank ports, and wherein in switching position of said valve means, said control pistons connect said fluid inlet port with said other working port and said one working port is connected with the other one of said tank port, and wherein upon faulty switching, said control pistons connect said fluid inlet port with said one working port and said other working port with said one tank port.

4. A safety valve as defined in claim 3, and further comprising a proportional pressure reducing valve coupled to said housing and having one side permanently connected to said other tank port and another side adapted for selective connection with said one tank port and said fluid inlet port in dependence on the pressure setting at said pressure reducing valve.

5. A safety valve assembly as defined in claim 1, and further comprising control means for adjusting the pressure prevailing at one of said working ports when the other one of said working ports communicates with said fluid inlet port and thus is at full supply pressure, said control means being permanently connected to one of said tank ports and adapted for selective connection with the other one of said tank ports and said fluid inlet port.

6. A safety valve assembly as defined in claim 5 wherein said control means includes a proportional pressure reducing valve for adjusting the pressure prevailing at said one working port in dependence on the pressure setting at said pressure reducing valve.

7. A safety valve assembly as defined in claim 1 wherein said actuating means includes two pilot valves mounted to said housing.

8. A safety valve assembly, comprising:

- a valve housing defining a bore and having a pump port, two tank ports and two working ports, with said working ports being connected to a fluid operated system;
- valve means including two valve bodies movable in opposite direction towards each other in said bore of said housing, each of said valve bodies including a working piston actuated by a pressure fluid and provided with three axially spaced control pistons for regulating the flow of pressure fluid between said pump port, said working ports and said tank ports; and
- two pilot valves for displacing said valve bodies in said bore of said housing between a normal position and a switching position wherein in normal position of said valve means, said control pistons connects said pump port with one of said working ports while said other working port is connected with one of said tank ports, and wherein in switching position of said valve means, said control pistons connect said pump port with said other working port and said one working port is connected with the other one of said tank port, and wherein upon faulty switching, said control pistons connect said pump port with said one working port and said other working port with said one tank port.

9. A safety valve assembly as defined in claim 8, and further comprising a proportional pressure reducing valve coupled to said valve means and having one side permanently connected to said other tank port and another side selectively connected with said one tank port and said pump port in dependence on the setting at said pressure reducing valve.

* * * * *